US008925540B2

(12) United States Patent
Yu et al.

(10) Patent No.: US 8,925,540 B2
(45) Date of Patent: Jan. 6, 2015

(54) OVEN

(75) Inventors: Kilyoung Yu, Changwon (KR); Byoungwoo Choi, Changwon (KR); Euisu Jung, Changwon (KR); Seungjun Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 90 days.

(21) Appl. No.: 13/553,706

(22) Filed: Jul. 19, 2012

(65) Prior Publication Data

US 2013/0019852 A1 Jan. 24, 2013

(30) Foreign Application Priority Data

Jul. 21, 2011 (KR) ..... 10-2011-0072663

(51) Int. Cl.

| | |
|---|---|
| ***F24C 15/00*** | (2006.01) |
| ***F23C 6/00*** | (2006.01) |
| ***F23C 5/00*** | (2006.01) |
| ***F23C 1/00*** | (2006.01) |
| ***F24C 15/22*** | (2006.01) |

(52) U.S. Cl.

CPC . *F24C 15/00* (2013.01); *F23C 6/00* (2013.01); *F23C 5/00* (2013.01); *F23C 1/00* (2013.01); *F24C 15/22* (2013.01)

USPC ..... 126/19 R; 126/273 R; 126/39 E; 219/395

(58) Field of Classification Search

CPC ..... F23C 1/00; F23C 6/00; F23C 5/00; F23C 5/08; F23C 6/02; F23C 6/04; F23C 2201/20; F23D 23/00; F23D 2204/00; F23D 2205/00; F23N 2037/02; F24C 3/087; F24C 5/12; F24C 7/06; F24C 7/065; F24C 15/22; F24C 15/00

USPC ..... 126/19 R, 273 R, 41 R, 39 BA, 39 E; 219/395, 396

See application file for complete search history.

(56) References Cited

U.S. PATENT DOCUMENTS

| | | | | |
|---|---|---|---|---|
| 3,423,568 | A * | 1/1969 | Meckley, III et al. | 126/21 R |
| 4,629,865 | A * | 12/1986 | Freedman et al. | 219/405 |
| 6,222,163 | B1 * | 4/2001 | Arntz et al. | 219/483 |

FOREIGN PATENT DOCUMENTS

| | | | |
|---|---|---|---|
| JP | 2005-241196 | A | 9/2005 |
| KR | 10-2009-0021037 | A | 2/2009 |
| KR | 10-2010-0119987 | A | 11/2010 |

* cited by examiner

*Primary Examiner* — Alfred Basichas

(74) *Attorney, Agent, or Firm* — Birch, Stewart, Kolasch & Birch, LLP

(57) ABSTRACT

An oven is provided. The oven includes an oven chamber having an interior surface, the interior surface including a first recess at an upper portion thereof and a second recess provided in a portion of the first recess, a first heat source disposed in the first recess to provide energy for cooking food placed in the oven chamber, and a second heat source disposed in the second recess to provide energy for cooking food placed in the oven chamber.

22 Claims, 9 Drawing Sheets

OVEN

CROSS-REFERENCE TO RELATED APPLICATIONS

This application is claims the benefit of priority to Korean Application No. 10-2011-0072663, filed on Jul. 21, 2011, which is herein incorporated by reference in its entirety.

BACKGROUND OF THE DISCLOSURE

1. Field of the Disclosure

The present disclosure relates generally to an oven and, more particularly, an electric oven having a plurality of heat sources in an oven chamber.

2. Description of Related Art

Electric ovens are used to cook foods with electricity. Such an electric oven includes an oven chamber for cooking food, and a heating source providing heat for cooking food is disposed in the oven chamber. Such heating sources may include a carbon heater or a sheath heater.

Generally, the heating source is located at an upper surface of the oven chamber. The upper surface is usually planar and the heating source takes the form of a sheath heater such that the sheath heater intrudes into a cooking space of the oven chamber.

BRIEF SUMMARY OF THE DISCLOSURE

Exemplary embodiments provide an oven configured to more efficiently and economically cook food.

In one exemplary embodiment, an oven is provided. The oven includes an oven chamber having an interior surface, the interior surface including a first recess at an upper portion thereof and a second recess provided in a portion of the first recess, a first heat source disposed in the first recess to provide energy for cooking food placed in the oven chamber, and a second heat source disposed in the second recess to provide energy for cooking food placed in the oven chamber.

In another exemplary embodiment, an oven includes an oven chamber and a heating assembly disposed at an upper side of the oven chamber. The heating assembly includes a first heat source and a heating module. The heating module includes a second heat source, a reflector to reflect energy from the second heat source into a portion of the oven chamber, and a grate. The second heat source, the reflector, and the grate are assembled as a single unit, and the heating module is located in the oven chamber such that the grate is located between the second heat source and the first heat source.

The details of one or more exemplary embodiments are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Reference will now be made in detail to the exemplary embodiments of the present disclosure, examples of which are illustrated in the accompanying drawings. While the exemplary embodiments will be described with reference to an electric oven, it is understood that the present disclosure is not so limited.

Figure 1:
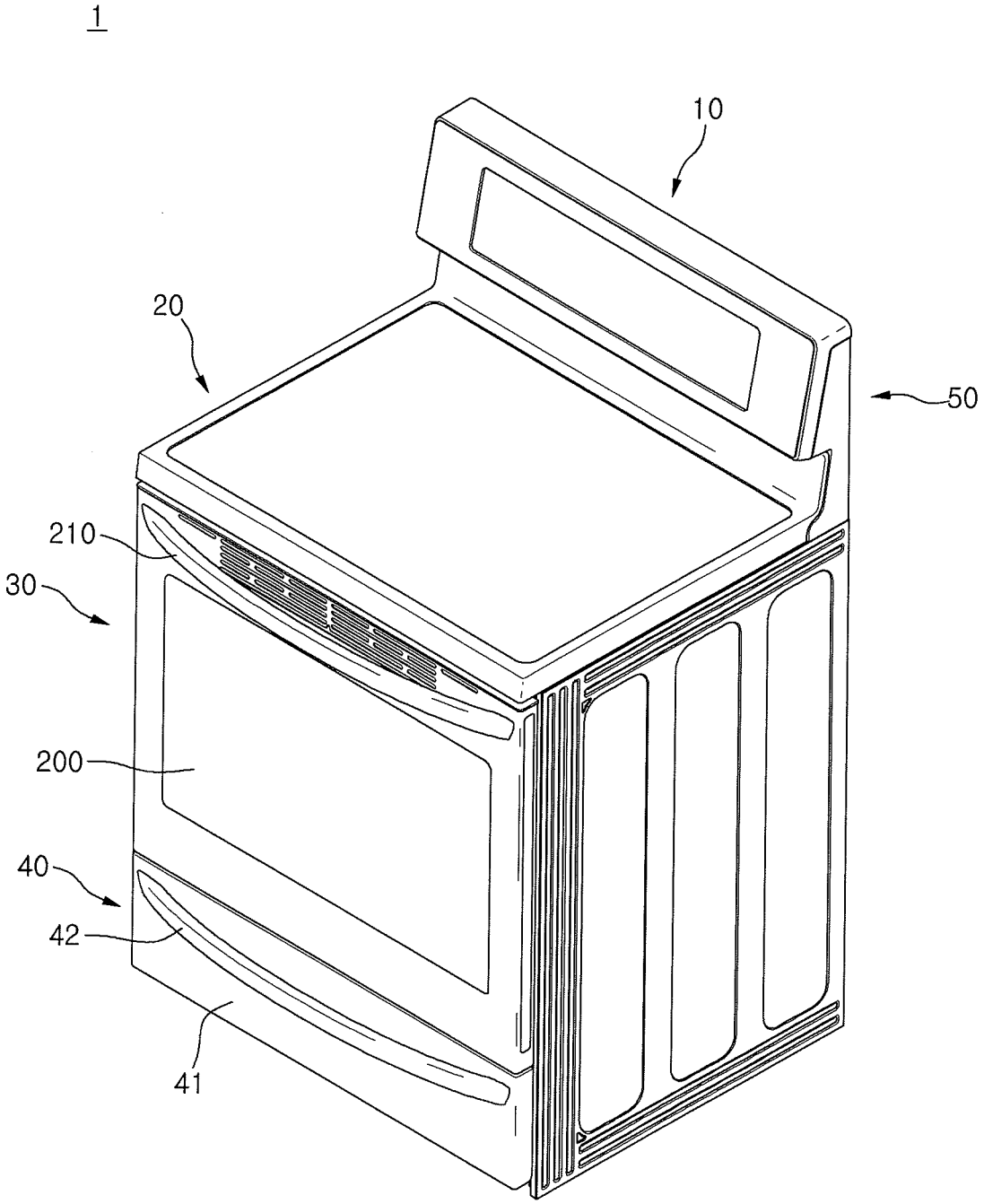
FIG. 1 is a perspective view illustrating an oven according to a first exemplary embodiment.
Figure 2:
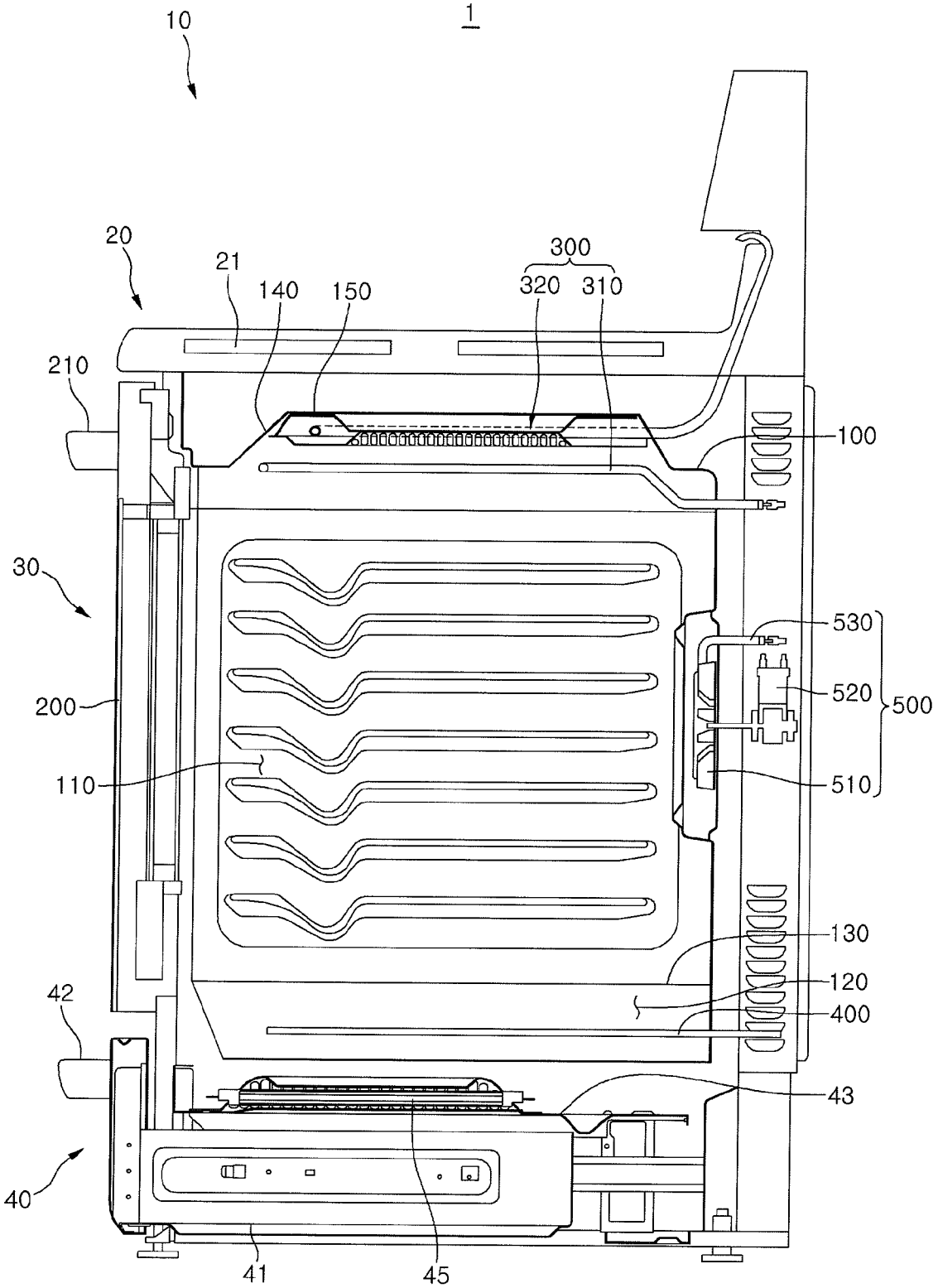
FIG. 2 is a schematic cross-sectional view illustrating the electric oven of FIG. 1.

Referring to FIGS. 1 and 2, a cooktop 20 is disposed at the upper side of a cabinet 10 of an electric oven 1. A plurality of cooktop heaters 21 for heating food is disposed in the cooktop 20.

An oven unit 30 is disposed in the cabinet 10 under the cooktop 20. The oven unit 30 includes a cavity 100 defining an oven chamber 110 for cooking food, a door 200 selectively opening and closing the oven chamber 110, and a plurality of heating sources providing energy for cooking food in the oven chamber 110.

More particularly, the cavity 100 may have a hexahedron shape with a front opening. A heater chamber 120 is disposed at the lower side of the cavity 100 under the oven chamber 110. A bake heater 400, which will be described below, is disposed in the heater chamber 120. A base plate 130 disposed in the cavity 100 divides an inner space of the cavity 100 into the oven chamber 110 and the heater chamber 120. The top surface of the base plate 130 provides the bottom surface of the oven chamber 110.

The door 200 may open and close the oven chamber 110 in a pull-down manner. The front upper end of the door 200 is provided with a door handle 210 that is held by a user to rotate the door 200.

The plurality of heating sources include a broil heating device 300 disposed at the upper side of the oven chamber 110, the baker heater 400 disposed in the heater chamber 120, and a convection device 500 disposed on the rear surface of the oven chamber 110. The broil heating device 300 provides radiation energy for cooking food in the oven chamber 110. The convection device 500 includes a convection fan 510 circulating air in the oven chamber 110, a convection motor 520 providing driving force for rotating the convection fan 510, and a convection heater 530 heating air circulated by the convection fan 510. The bake heater 400 and the convection heater 530 may be typical sheath heaters. At least one of the broil heating device 300, the bake heater 400, and the convection device 500 operates according to a cooking mode to provide energy for cooking food in the oven chamber 110. The broil heating device 300 will be described in greater detail below.

A drawer unit 40 is disposed at the lower side of the cabinet 10 under the oven unit 30. The drawer unit 40 warms up food or a container storing food. The drawer unit 40 includes a drawer 41 that is pushed into or pulled out of the cabinet 10, and a drawer casing 43 that surrounds the drawer 41 in the cabinet 10. A drawer handle 42 is disposed on the front surface of the drawer 41. A warming heater 45 is disposed in the drawer casing 43 to warm up food container accommodated in the drawer 41.

A control panel 50 is disposed at a top rear end of the cabinet 10 behind the cooktop 20. Signals for operating the cooktop 20, the oven unit 30, and the drawer unit 40 are input to the control panel 50. The control panel 50 displays information about operations of the cooktop 20, the oven unit 30, and the drawer unit 40.

Hereinafter, a broil heating device of the electric oven according to the first exemplary embodiment will be described in detail with reference to FIGS. 3-8.

Figure 3:
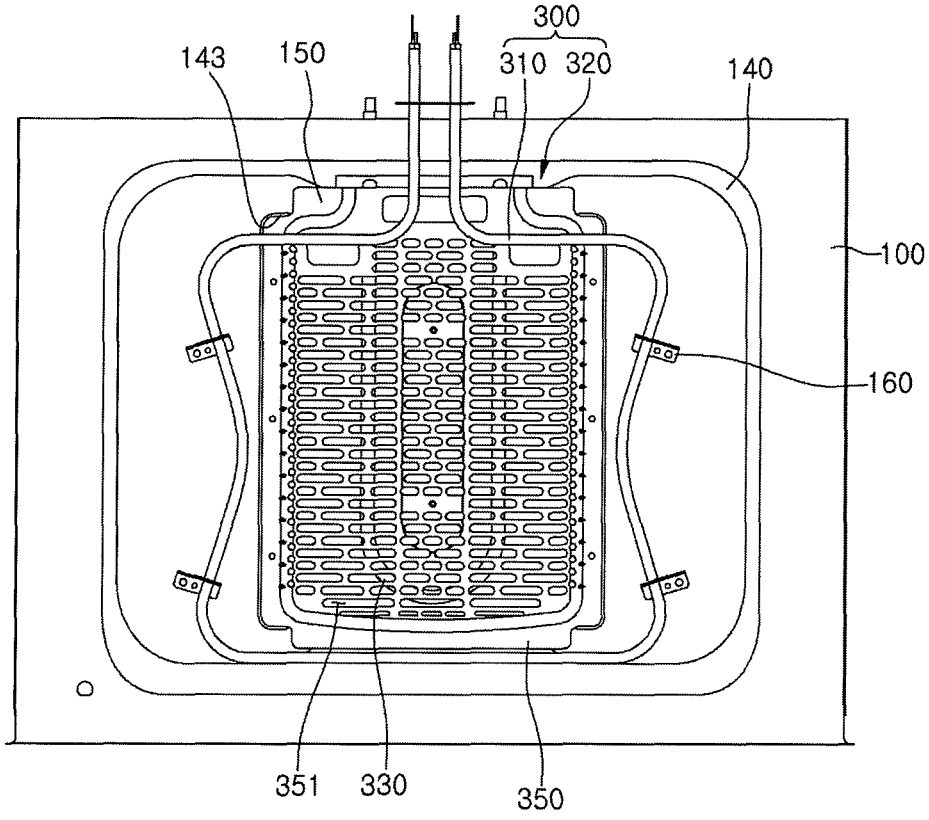
FIG. 3 is a plan view illustrating a ceiling of an oven chamber provided with a broil heating device according to the first exemplary embodiment.
Figure 4:
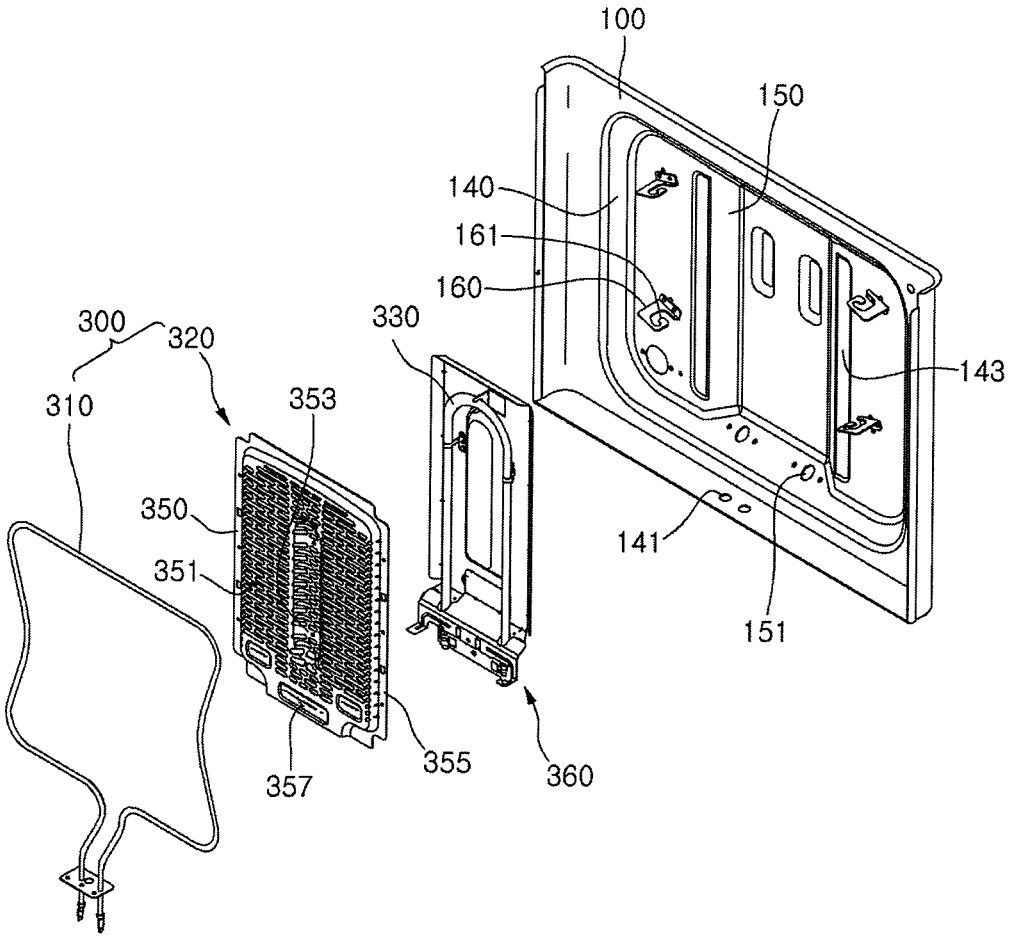
FIG. 4 is an exploded perspective view illustrating the broil heating device of FIG. 3.

Referring to FIGS. 3 and 4, the top surface of the cavity 100 corresponding to a ceiling surface of the oven chamber 110 is provided with a first recess 140 and a second recess 150. The first recess 140 is formed by protruding a portion of the top surface of the cavity 100. The second recess 150 is formed by protruding a portion of the first recess 140. The top and bottom surfaces of the first recess 140 may be flush or continuous with those of the second recess 150. The broil heating device 300 is disposed in the first and second recesses 140 and 150 to reduce a space taken by the broil heating device 300 in the oven chamber 110.

The cavity 100 is provided with first heater through holes 141 and second heater through holes 151. Both ends of a first broil heater 310 extending out of the oven chamber 110 pass through the first heater through holes 141. Both ends of a second broil heater 330 extending out of the oven chamber 110 pass through the second heater through holes 151.

The first heater through holes 141 are formed in the rear surface of the oven chamber 110 under the first recess 140. The second heater through holes 151 are disposed in a rear surface of the second recess 150. Thus, the first heater through holes 141 are disposed under the second heater through holes 151. The first heater through holes 141 are farther away from both side surfaces of the oven chamber 110 than the second heater through holes 151. The second heater through holes 151 have a greater diameter than a diameter of the second broil heater 330. Accordingly, the second broil heater 330 is prevented from contacting surfaces defining the second heater through holes 151, thereby protecting the second broil heater 330.

Seat recesses 143 adjacent to the second recess 150 are provided in the first recess 140. Each seat recess 143 is formed by protruding a portion of the first recess 140 upward. A depth of the seat recesses 143 is smaller than that of the second recess 150. Installation flanges 355 of a grate 350, which will be described below, are seated on the seat recesses 143.

The ceiling surface of the oven chamber 110 is provided with a plurality of support brackets 160 in the first recess 140. The support brackets 160 support the first broil heater 310. Each support bracket 160 includes an insertion slot 161 that receives a side of the first broil heater 310. The insertion slot 161 for preventing a removal of the first broil heater 310 from the support bracket 160 is formed by cutting out a portion of the support bracket 160 along a predetermined curve. For example, an end of the insertion slot 161 through which the first broil heater 310 is inserted may be disposed over the other end thereof. Thus, unexpected removal of the first broil heater 310 from the insertion slot 161 is prevented by the weight of the first broil heater 310.

The broil heating device 300 includes the first broil heater 310 disposed in the first recess 140 and a heating module 320 including the second broil heater 330 disposed in the second recess 150. The first and second broil heaters 310 and 330 provide energy, such as light and/or heat, for cooking food in the oven chamber 110. For example, the first broil heater 310 may be a sheath heater, and the second broil heater 330 may be a quartz heater including a quartz tube, such as a halogen heater, a carbon heater, or a ceramic heater. That is, the second broil heater 330 may have higher power than the first broil heater 310.

The first broil heater 310 may have a generally polygonal shape such as a rectangular shape, as a whole. Thus, the first broil heater 310 extends along the edge of the ceiling surface of the oven chamber 110. Both ends of the first broil heater 310 extend in the same direction out of the oven chamber 110 through the first heater through holes 141. Both the ends of the first broil heater 310 are lower than the rest of the first broil heater 310. That is, the rest of the first broil heater 310 is disposed in the first recess 140, and the ends thereof pass through the first heater through holes 141 under the first recess 140.

Referring to FIGS. 5-8, the heating module 320 include the second broil heater 330, a reflector 340 reflecting energy from the second broil heater 330, the grate 350 between the second broil heater 330 and the bottom surface of the oven chamber 110, and a heater supporter 360 supporting both ends of the second broil heater 330. The rest of the heating module 320 except for the rear end thereof is disposed in the second recess 150 to prevent a vertical overlap of the first broil heater 310 and the heating module 320.

The second broil heater 330 has an approximately U shape, but is not limited thereto, provided that both ends thereof extend in the same direction. The second broil heater 330 may extend in the back-and-forth direction in the middle of the ceiling surface of the oven chamber 110. In other words, the second broil heater 330 may be disposed inside the first broil heater 310 such that a projection of the first broil heater 310 on the bottom surface of the oven chamber 110 crosses a projection of the second broil heater 330 on the bottom surface of the oven chamber 110 at two points.

The reflector 340 has a flat polygonal shape with a bottom opening. The reflector 340 has a shape and a size to be disposed in the second recess 150. The second broil heater 330 is disposed in the reflector 340. Energy emitted from the second broil heater 330 is directed downward, that is, to the inside of the oven chamber 110 by the reflector 340.

The top of the reflector 340 is provided with a grate fixing part 341. The grate fixing part 341 is formed by recessing the central portion of the top of the reflector 340 downward to correspond to the shape of the second broil heater 330. The grate fixing part 341 fixes the reflector 340 to the grate 350 and reinforces the reflector 340. The grate fixing part 341 has a U shaped horizontal cross section corresponding to the shape of the second broil heater 330, thereby efficiently reflecting energy from the second broil heater 330.

The reflector 340 includes heater through holes 343. The ends of the second broil heater 330 pass through the heater through holes 343 such that the ends of the second broil heater 330 sequentially pass through the heater through holes 343 and the second heater through holes 151, and then, extend out of the oven chamber 110. Like the second heater through holes 151, the heater through holes 343 passing through the rear surface of the reflector 340 have a greater diameter than the diameter of the second broil heater 330. Accordingly, contact between the second broil heater 330 and a surface defining the heater through holes 343 can be prevented, and both the ends of the second broil heater 330 passing through the heater through holes 343 can form a predetermined inclination angle with the reflector 340. That is, since the second broil heater 330 can obliquely move at a predetermined angle, when the ends of the second broil heater 330 pass through the heater through holes 343, interference between the second broil heater 330 and a support rib 345.

The top of the reflector 340 is provided with the support rib 345. The support rib 345 supports the second broil heater 330 to prevent the second broil heater 330 from moving in the back-and-forth direction of the reflector 340 so that an unexpected removal of the ends of the second broil heater 330 from the heater through holes 343 can be prevented. The support rib 345 is formed by cutting and bending a portion of the top of the reflector 340. The lower end of the support rib 345 is provided with a support recess 346 for supporting the second broil heater 330. The support recess 346 is formed by partially cutting the lower end of the support rib 345. The support recess 346 may have a size greater than the diameter of the second broil heater 330. The center of the second broil heater 330 is supported in the support recess 346.

The top of the reflector 340 is provided with a plurality of elastic support holders 347. When the ends of the second broil heater 330 pass through the heater through holes 343, and the center of the second broil heater 330 is supported by the support rib 345, the elastic support holders 347 prevent the second broil heater 330 from moving in the up-and-down direction and the left-and-right direction of the reflector 340. The elastic support holders 347 elastically support the second broil heater 330.

Figure 6:
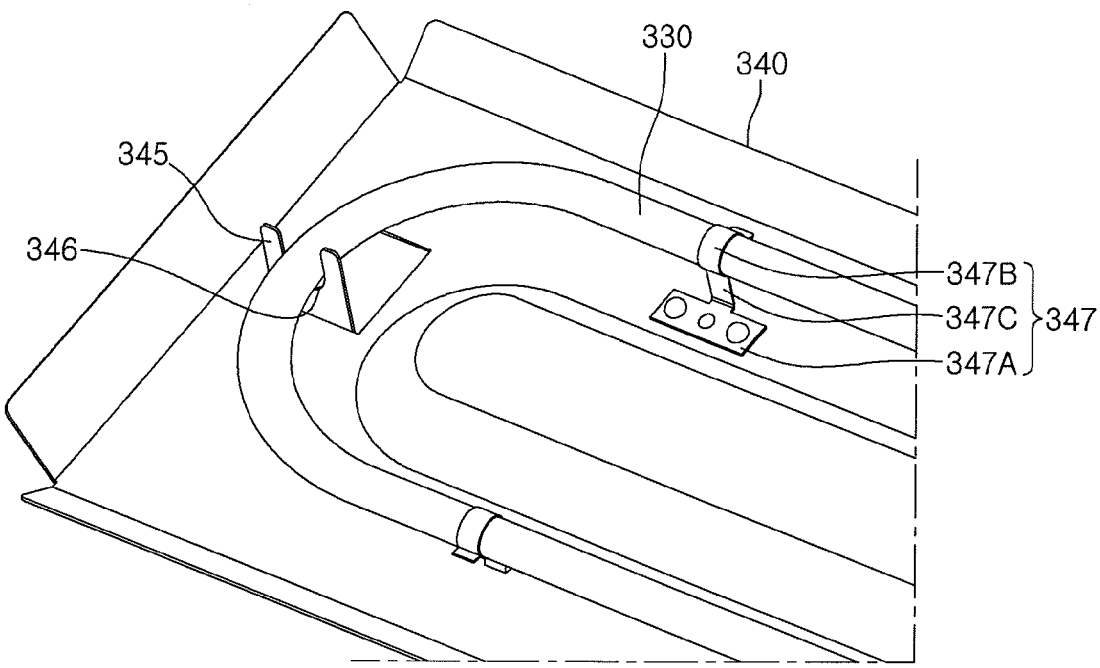
FIG. 6 is a perspective view illustrating a portion of the heating module of FIG. 5.

Referring to FIG. 6, the elastic support holder 347 includes a fixing part 347A fixed to the top of the reflector 340, a seat part 347B on which the second broil heater 330 is seated, and a connecting part 347C connecting the fixing part 347A to the seat part 347B. The fixing part 347A may be fixed to the top of the reflector 340 by fasteners such as screws or rivets. The seat part 347B is rounded with a predetermined curvature. The lower outer surface of the second broil heater 330 is seated on the seat part 347B. The seat part 347B and the connecting part 347C are elastically deformable by external force, and thus, the second broil heater 330 is elastically supported by the elastic support holder 347.

Figure 7:
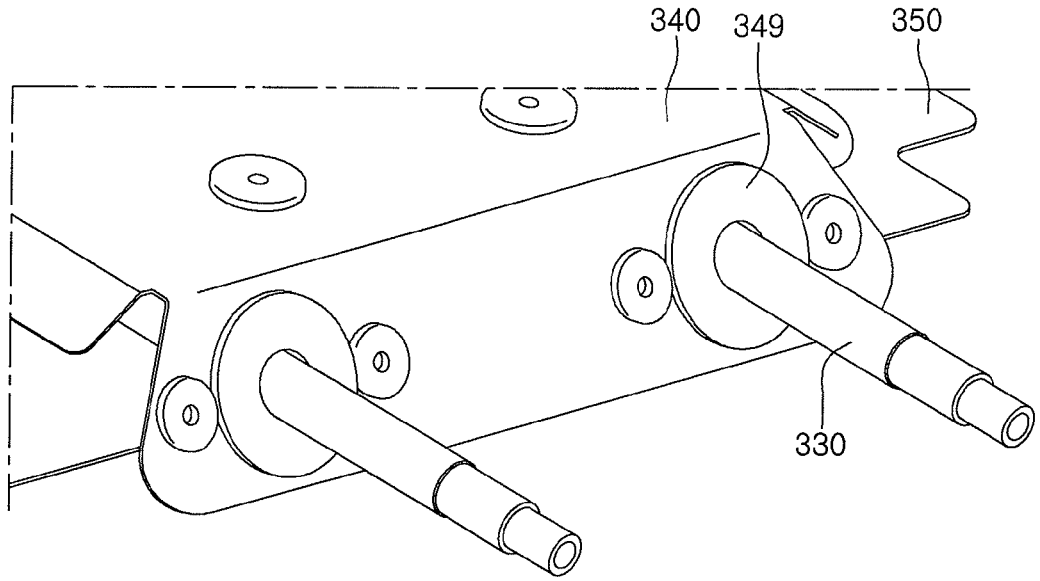
FIG. 7 is a perspective view illustrating a portion of the heating module of FIG. 5.

Referring to FIG. 7, gaskets 349 adjacent to the heater through holes 343 are disposed on the rear portion of the reflector 340. The gaskets 349 prevent a leakage of energy between the second broil heater 330 and the heater through holes 343. The gasket 349 may be formed from a woven metal such as a woven brass material, and thus be flexible to protect the second broil heater 330. The gasket 349 may be welded to the rear portion of the reflector 340 to partially close the edge of the heater through hole 343.

Figure 5:
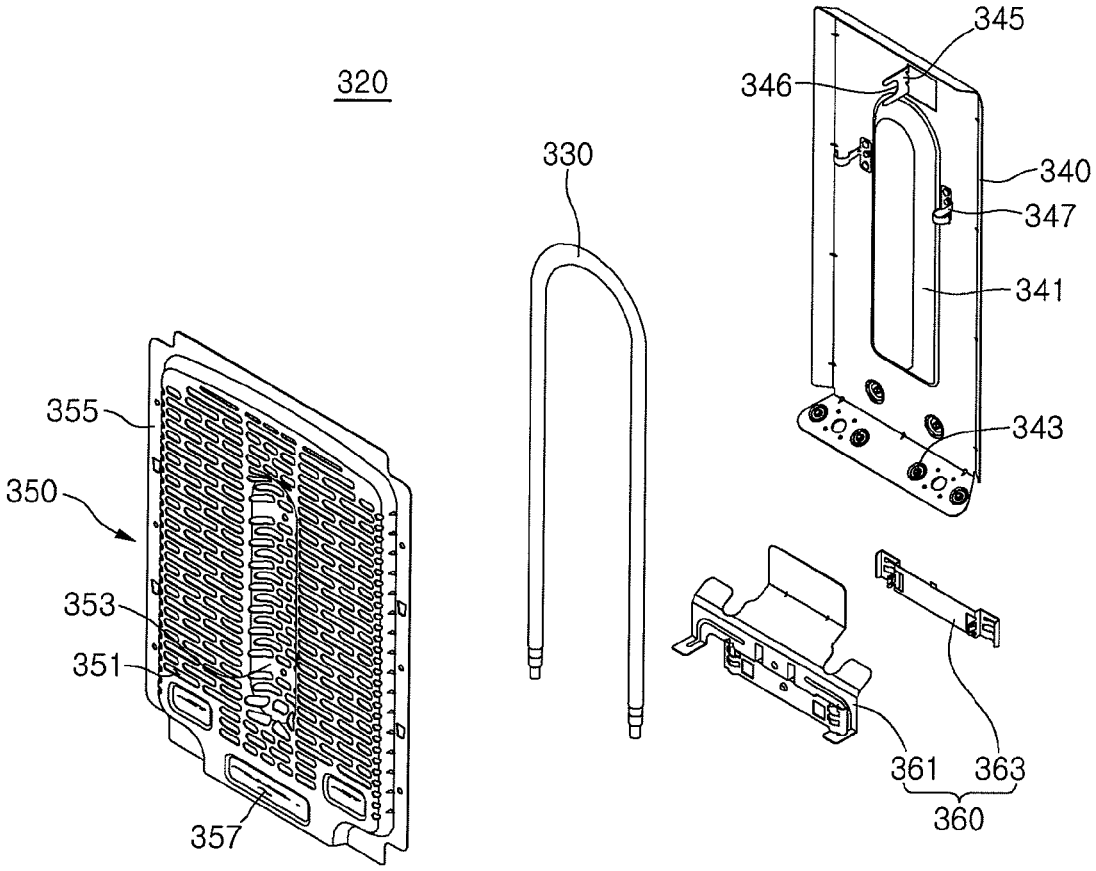
FIG. 5 is an exploded perspective view illustrating a heating module according to the first exemplary embodiment.
Figure 8:
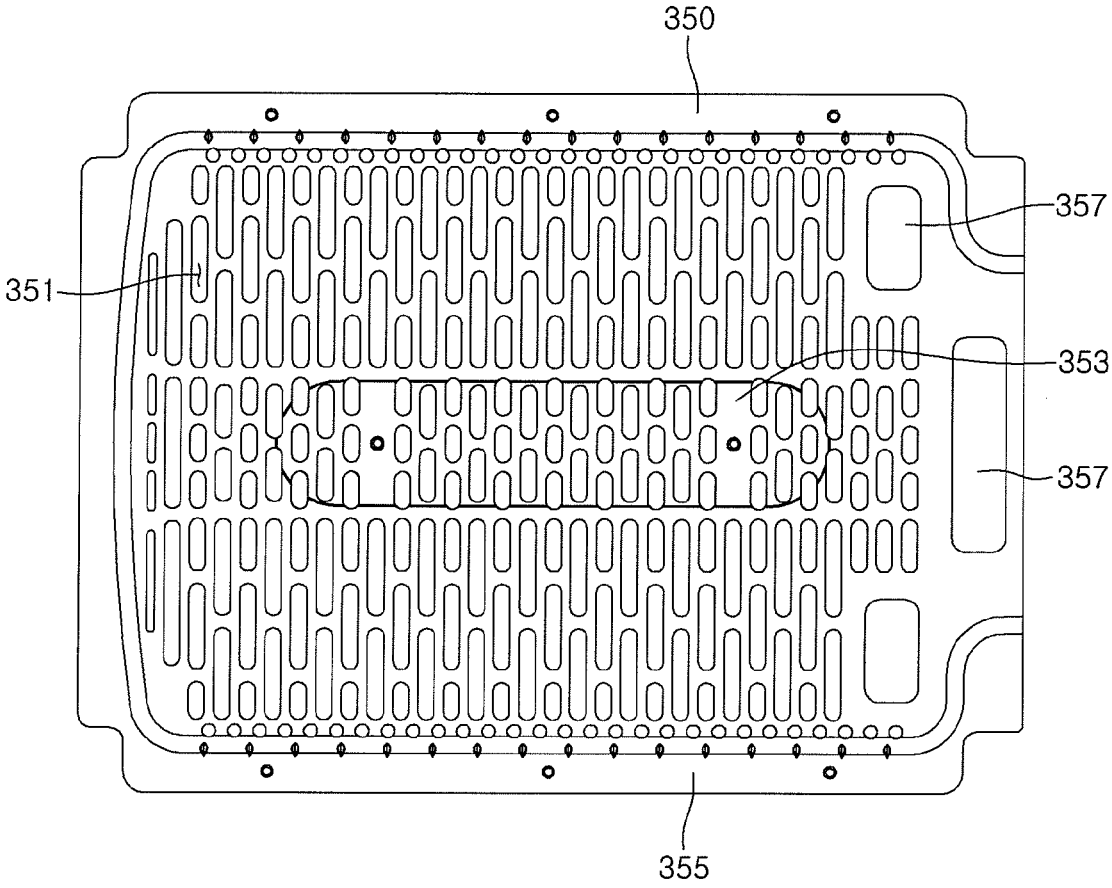
FIG. 8 is a plan view illustrating a grate according to the first exemplary embodiment.

Referring to FIGS. 5 and 8, the grate 350 has a predetermined shape, for example, a plate shape having a size corresponding to a horizontal cross section of the second recess 150. The grate 350 is disposed between the second broil heater 330 and the bottom surface of the oven chamber 110 to transfer energy from the second broil heater 330 to the oven chamber 110 and prevent an external foreign substance from contacting the second broil heater 330.

The grate 350 includes a plurality of communication holes 351. Energy is transferred from the second broil heater 330 into the oven chamber 110 substantially through the communication holes 351. When the heating module 320 is disposed in the first recess 140, the number of the communication holes 351 disposed in a portion of the grate 350 vertically overlapping the first broil heater 310 is smaller than the number thereof in the rest of the grate 350. In other words, an open area in the portion of the grate 350 vertically overlapping the first broil heater 310 is smaller than that in the rest of the grate 350.

The grate 350 is fixed to the reflector 340 by a fastener. To this end, the grate 350 includes a reflector fixing part 353. The reflector fixing part 353 is formed by protruding the center of the grate 350 upward. The top surface of the reflector fixing part 353 is fixed to the bottom surface of the grate fixing part 341. In this state, a fastener (not shown) passing through the reflector fixing part 353 is coupled to the grate fixing part 341 to fix the reflector 340 and the grate 350 to each other.

The grate 350 includes the installation flanges 355 at both ends thereof. The installation flanges 355 are used to fix the grate 350 to the top surface of the cavity 100. The installation flanges 355 extend outward from the ends of the grate 350. When the heating module 320 is disposed in the second recess 150, the installation flanges 355 are seated in the seat recesses 143 and are fixed to the cavity 100 by fasteners (not shown).

The grate 350 includes reinforcement recesses 357. When the heating module 320 is disposed in the first recess 140, the reinforcement recesses 357 are disposed in the portion of the grate 350 vertically overlapping the first broil heater 310. The reinforcement recesses 357 prevent deformation of the grate 350 due to heat from the first broil heater 310. Thus, at least one portion of the reinforcement recesses 357 vertically overlaps the first broil heater 310.

Referring to FIG. 5, the heater supporter 360 elastically supports the ends of the second broil heater 330 sequentially passing through the heater through holes 343 and the second heater through holes 151 and extending to the rear side of the oven chamber 110. The heater supporter 360 includes a first supporter 361 fixed to an outer portion of the cavity 100, and a second supporter 363 coupled to the first supporter 361. The first supporter 361 is coupled to the second supporter 363 to support the ends of the second broil heater 330.

A process of installing a broil heating device according to the current exemplary embodiment will now be described. First, the second broil heater 330 is fixed to the reflector 340. In particular, the second broil heater 330 is obliquely moved at a predetermined angle to insert the ends of the second broil heater 330 into the heater through holes 343. Then, the second broil heater 330 is rotated about the ends thereof such that the center of the second broil heater 330 is supported by the support rib 345. At this point, or thereafter, the second broil heater 330 is also supported by the elastic support holders 347. Thus, when the ends of the second broil heater 330 pass through the heater through holes 343, the second broil heater 330 is prevented from moving in the back-and-forth direction and the left-and-right direction of the reflector 340. The gaskets 349 substantially close the gaps between the second broil heater 330 and the heater through holes 343.

Next, the grate 350 is fixed to the reflector 340. The grate fixing part 341 contacts the reflector fixing part 353 and a fastener passing through the reflector fixing part 353 is coupled to the grate fixing part 341 to fix the grate 350 to the reflector 340. Since the grate 350 is fixed to the reflector 340, assembling of the heating module 320 is substantially completed.

Then, the heating module 320 is obliquely moved at a predetermined angle into the oven chamber 110 to insert the ends of the second broil heater 330 into the second heater through holes 151, thereby installing the heating module 320 in the oven chamber 110. Then, the heating module 320 is rotated about the ends of the second broil heater 330 to dispose the heating module 320 in the second recess 150.

When the ends of the second broil heater 330 passes through the second heater through holes 151, the grate 350 is fixed to the ceiling surface of the oven chamber 110. Specifically, when the installation flanges 355 are seated on the seat recesses 143, fasteners passing through the installation flanges 355 fix the grate 350 to the ceiling surface of the oven chamber 110.

Then, the ends of the second broil heater 330 passing through the second heater through holes 151 and extending to the rear side of the oven chamber 110 are supported by the heater supporter 360. Specifically, the first supporter 361 is fixed to the outer portion of the cavity 100 to support the lower portions of the ends of the second broil heater 330. The second supporter 363 is coupled to the first supporter 361 to contact the upper portions of the ends of the second broil heater 330. Thus, the ends of the second broil heater 330 are supported by the first and second supporters 361 and 363, that is, the heater supporter 360.

When the installation of the heating module 320 is completed, the first broil heater 310 is installed in the oven chamber 110. First, the first broil heater 310 is moved into the oven chamber 110 to insert the ends of the first broil heater 310 into the first heater through holes 141. Then, when the ends of the first broil heater 310 pass through the first heater through holes 141, the ends of the first broil heater 310 are fixed to the rear surface of the oven chamber 110. In this state, the first broil heater 310 is supported by the support brackets 160, and is fixed to the ceiling surface of the oven chamber 110. Thus, the first broil heater 310 is fixed in the oven chamber 110. Then, the rest of the first broil heater 310 except for the ends of the first broil heater 310 is disposed in the first recess 140.

A process of cooking food with a broil heating device according to the current exemplary embodiment will now be described. The broil heating device 300 is operated to heat food in the oven chamber 110. At this point, the bake heater 400 and/or the convection device 500 may be operated according to a user's selection.

The broil heating device 300 includes two heating sources, that is, the first and second broil heaters 310 and 330. In addition, the second broil heater 330 outputting relatively high power is disposed at the center of the ceiling surface of the oven chamber 110, and the first broil heater 310 outputting relatively low power is disposed at the edge of the ceiling surface. Thus, when food is placed on the central bottom surface of the oven chamber 110, the food can be intensively heated by the second broil heater 330, and inner temperature of the oven chamber 110 can be increased by the first broil heater 310.

As described above, one portion of the first broil heater 310 vertically overlaps the heating module 320, particularly, the grate 350. Thus, the portion of the grate 350 vertically overlapping the first broil heater 310 may be more intensively heated than the rest of the grate 350, and thus, be damaged or deformed thermally. However, according to the current exemplary embodiment, the portion of the grate 350 overlapping the first broil heater 310 is provided with the reinforcement recesses 357. Thus, damage or thermal deformation of the grate 350 due to heat from the first broil heater 310 can be prevented.

Hereinafter, an electric oven according to a second exemplary embodiment will be described in detail with reference to FIG. 9. Like reference numerals denote like elements in the first and second exemplary embodiments, and a description of the same components as those of the first exemplary embodiment will be omitted in the second exemplary embodiment.

Figure 9:
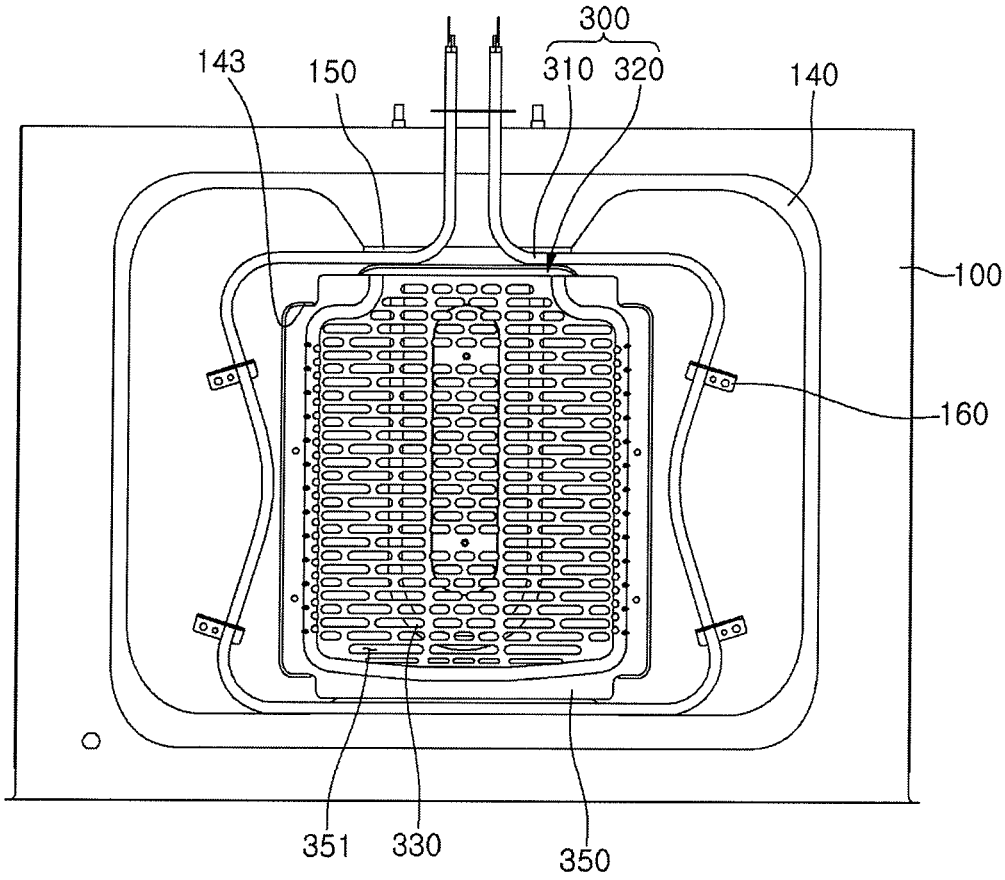
FIG. 9 is a plan view illustrating a ceiling of an oven chamber provided with a broil heating device according to a second exemplary embodiment.

Referring to FIG. 9, a rear surface of a second recess 150 is disposed in front of a rear surface of a first recess 140. The first broil heater 310 disposed in the first recess 140 does not vertically overlap the heating module 320. In other words, a projection of a second broil heater 330 on the bottom surface of the oven chamber 110 may be disposed inside a projection of the first broil heater 310 on the bottom surface of the oven chamber 110. Thus, the possibility of damage and deformation of the grate 350 due to heat from the first broil heater 310 is reduced, and thus, the reinforcement recesses 357 may be removed.

According to the above exemplary embodiments, the first broil heater has a rectangular shape, as a whole, but is not limited thereto, and thus, may have other shapes including circular shapes.

In addition, the heating sources include the broil heating device, the bake heater, and the convection device, but are not limited thereto, and thus, may include only the broil heating device, or include the broil heating device and one of the bake heater and the convection device.

In addition, although the convection device includes the convection heater, the convection heater may be removed.

According to the exemplary embodiments, the broil heating device includes the two broil heaters without reducing the volume of the oven chamber, so as to efficiently cook food.

Although exemplary embodiments have been described with reference to a number of illustrative exemplary embodiments thereof, it should be understood that numerous other modifications and exemplary embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oven comprising:

an oven chamber having an interior surface, the interior surface including a first recess at an upper portion thereof and a second recess provided in a portion of the first recess;

a first heat source disposed in the first recess to provide energy for cooking food placed in the oven chamber;

a second heat source disposed in the second recess to provide energy for cooking food placed in the oven chamber;

a reflector located between the second heat source and the upper portion of the interior surface; and a grate to cover the second heat source, the grate being provided with one or more communication holes, wherein the grate is coupled to the reflector and the grate is located between the second heat source and the first heat source.

2. The oven according to claim 1, wherein the first heat source is a first broil heater having a generally polygonal shape, and wherein the second heat source is a second broil heater disposed between the first broil heater and the second recess.

3. The oven according to claim 2, wherein a projection of the first broil heater on a bottom surface of the oven chamber crosses a projection of the second broil heater on the bottom surface of the oven chamber at two points.

4. The oven according to claim 1, wherein a projection of the second heat source on a bottom surface of the oven chamber is disposed inside a projection of the first heat source on the bottom surface.

5. The oven according to claim 1, wherein the first heat source includes a sheath heater and the second heat source includes a quartz heater.

6. The oven according to claim 1, wherein the second heat source is supported by the reflector.

7. The oven according to claim 1, wherein a recess of the reflector contacts a protrusion of the grate, and wherein the reflector and the grate are fixed by a fastener.

8. The oven according to claim 1, wherein a bottom surface of the grate and a bottom surface of the second recess are disposed on the same plane or the bottom surface of the grate is disposed below the bottom surface of the second recess.

9. The oven according to claim 1, wherein the upper portion of the oven chamber includes a seat recess protruded upward from a portion of the first recess adjacent to the second recess such that a portion of the grate is seated in the seat recess.

10. The oven according to claim 1, wherein the grate includes a reinforcement recess protruded upward from a portion of the grate, and wherein at least one portion of the reinforcement recess overlaps the first heat source.

11. An oven comprising:

oven chamber; and a heating assembly disposed at an upper side of the oven chamber, the heating assembly including:

a first heat source; and a heating module, the heating module including:

a second heat source;

a reflector to reflect energy from the second heat source into a portion of the oven chamber; and a grate, wherein the second heat source, the reflector, and the grate are assembled as a single unit, and wherein the heating module is located in the oven chamber such that the grate is located between the second heat source and the first heat source.

12. The oven according to claim 11, wherein the oven chamber includes an interior surface having a first recess at an upper portion thereof and a second recess provided in a portion of the first recess, wherein the first heater source is located at the first recess, and wherein the heating module is located at the second recess.

13. The oven according to claim 12, wherein inner surface of the oven chamber includes a seat recess formed in a portion of the first recess adjacent to the second recess, and wherein the grate includes an installation flange seated in the seat recess and contacting a top surface of the interior surface of the oven chamber.

14. The oven according to claim 13, wherein, when the installation flange is seated in the seat recess, a bottom surface of the grate and a bottom surface of the second recess are disposed on the same plane or the bottom surface of the grate is disposed below the bottom surface of the second recess.

15. The oven according to claim 11, wherein a portion of the first heater source vertically overlaps a portion of the grate, wherein the grate includes a plurality of communication holes for supplying energy from the second heat source to the oven chamber, and wherein the number of the communication holes disposed in the portion of the grate vertically overlapping the portion of the first heat source is smaller than the number of the communication holes disposed in the rest of the grate.

16. The oven according to claim 11, wherein a portion of the first heat source vertically overlaps a portion of the grate, and wherein the grate includes a reinforcement recess in the portion vertically overlapping the portion of the first heat source to prevent deformation of the grate by heat from the first heat source.

17. The oven according to claim 11, wherein the reflector includes a grate fixing part protruding downward towards the grate, wherein the grate includes a reflector fixing part protruding upward towards the reflector, and wherein the grate fixing part contacts the reflector fixing part.

18. The oven according to claim 17, wherein the second heat source is supported by the reflector.

19. The oven according to claim 11, wherein the reflector and an upper surface of the oven chamber includes heater through holes, and wherein both ends of the second heat source pass sequentially through the heater through holes disposed in the reflector and heater through holes disposed in the oven chamber.

20. The oven according to claim 19, further comprising a bracket located outside of the oven chamber, wherein the heating module is fixed to the upper surface of the oven chamber by both ends of the second heat source being in engagement with the bracket.

21. The oven according to claim 20, further comprising a woven metal gasket disposed adjacent to each of the heater through holes of the reflector.

22. An oven comprising:

an oven chamber having a top plate provided with a recess;

a first heat source disposed in the recess to provide energy for cooking food placed in the oven chamber;

a second heat source disposed above the first heat source;

one or more support brackets connected to the top plate to support the first heat source;

a reflector located between the second heat source and top plate; and a grate to cover the second heat source, the grate being provided with one or more communication holes, wherein the grate is coupled to the reflector and the grate is disposed between the second heat source and the first heat source.

* * * * *